US008523423B2

(12) United States Patent
Huang

(10) Patent No.: US 8,523,423 B2
(45) Date of Patent: Sep. 3, 2013

(54) LED MOUNTING SEAT

(71) Applicant: Quan Mei Technology Co., Ltd, Tainan (TW)

(72) Inventor: Kuo-Hsien Huang, Tainan (TW)

(73) Assignee: Quan Mei Technology Co., Ltd (TW)

( * ) Notice: Subject to any disclaimer, the term of this patent is extended or adjusted under 35 U.S.C. 154(b) by 0 days.

(21) Appl. No.: 13/650,286

(22) Filed: Oct. 12, 2012

(65) Prior Publication Data

US 2013/0182447 A1 Jul. 18, 2013

(30) Foreign Application Priority Data

Jan. 12, 2012 (TW) ..... 101200756 U

(51) Int. Cl.
*H01R 33/00* (2006.01)

(52) U.S. Cl.
USPC ..... 362/646; 362/652; 362/657; 439/56

(58) Field of Classification Search
USPC ..... 362/646, 647, 652–659, 249.02; 439/56
See application file for complete search history.

(56) References Cited

U.S. PATENT DOCUMENTS 5,368,503 A * 11/1994 Savage, Jr. ..... 439/502
6,045,365 A * 4/2000 Kihara ..... 439/56
6,270,355 B1 * 8/2001 Kihara ..... 439/56
2010/0296286 A1 * 11/2010 Cheng ..... 362/249.02

* cited by examiner

*Primary Examiner* — Thomas Sember

(74) *Attorney, Agent, or Firm* — Stroock & Stroock & Lavan LLP

(57) ABSTRACT

An LED mounting seat includes a main body having a supporting surface that abuts against a light emitting portion of an LED, a connecting end that is connected to a circuit board, and a side surface that interconnects the supporting surface and the connecting end. The side surface is formed with a pair of lateral grooves. Each of the lateral grooves is defined by a groove-defining surface that has an abutting surface portion facing an opening of the corresponding one of the lateral grooves. The LED has two leads extending respectively through the lateral grooves and abutting respectively against the abutting surface portions of the groove-defining surfaces.

2 Claims, 8 Drawing Sheets

LED MOUNTING SEAT

CROSS-REFERENCE TO RELATED APPLICATION

This application claims priority of Taiwanese Application No. 101200756, filed on Jan. 12, 2012.

BACKGROUND OF THE INVENTION

1. Field of the Invention

This invention relates to an LED mounting seat, more particularly to an LED mounting seat adapted to mount a light emitting diode to a circuit board.

2. Description of the Related Art

Referring to FIGS. 1 and 2, a conventional light emitting diode (LED) mounting seat 1 is used in, for example, a vehicle lighting system, and includes a plurality of reflector covers 11 (only one is shown), and a circuit board 12 interlocked with the reflector covers 11. Each of the reflector covers 11 has a through hole 111. The conventional LED mounting seat 1 further includes a plurality of LEDs 13 (only one is shown) extending respectively through the through holes 111 and electrically connected to the circuit board 12.

Each of the LEDs 13 includes a light emitting portion 131 received in a respective one of the through holes 111, and a pair of leads 132 (only one is visible) electrically connected to the light emitting portion 131, extending respectively through two lead-inserting holes 121 (only one is visible) of the circuit board 12 and soldered to a bottom surface of the circuit board 12.

In a process of assembling the conventional LED mounting seat 1, the reflector covers 11 and the circuit board 12 are first interlocked as a unit followed by inserting the LEDs 13 into the through holes 111. The leads 132 of each LED 13 extend respectively through the corresponding pair of the lead-inserting holes 121 and are soldered to the circuit board 12.

However, it is difficult to precisely insert the leads 132 of each of the LEDs 13 into the corresponding lead-inserting holes 121 after the LEDs 13 are inserted into their corresponding through holes 111. The assembling of the LEDs 13 with the circuit boards 12 is becoming more difficult owing to the recent unrestrained and irregular design of the reflector cover 11. Additionally, for each of the LEDs 13, the light emitting portion 131 is merely supported on and secured to the circuit board 12 by the leads 132, so that the light emitting portion 131 has a tendency to shake which jeopardizes the effect of safety lighting and which may even cause detachment of the leads 132 from the circuit board 12 and malfunction of the LED 13.

SUMMARY OF THE INVENTION

Therefore, an object of this invention is to provide an LED mounting seat adapted to rapidly, precisely and stably mount a LED to a circuit board.

Accordingly, an LED mounting seat of the present invention is adapted to mount a LED to a circuit board. The LED has a light emitting portion and a pair of leads extending from a bottom surface of the light emitting portion. Each of the leads has a distal end that extends through the circuit board and that is secured to a bottom surface of the circuit board.

The LED mounting seat comprises a main body having a supporting surface, a connecting end and a side surface. The supporting surface is adapted to abut against the bottom surface of the light emitting portion of the LED. The connecting end is adapted to be connected to a top surface of the circuit board opposite to the bottom surface of the circuit board. The side surface interconnects the supporting surface and the connecting end, and is formed with opposite lateral grooves extending from the supporting surface to the connecting end. Each of the lateral grooves has an opening that is between the supporting surface and the connecting end, and is defined by a groove-defining surface that has an abutting surface portion facing the opening. The leads of the LED extend respectively through the lateral grooves and abut respectively against the abutting surface portions of the groove-defining surfaces.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
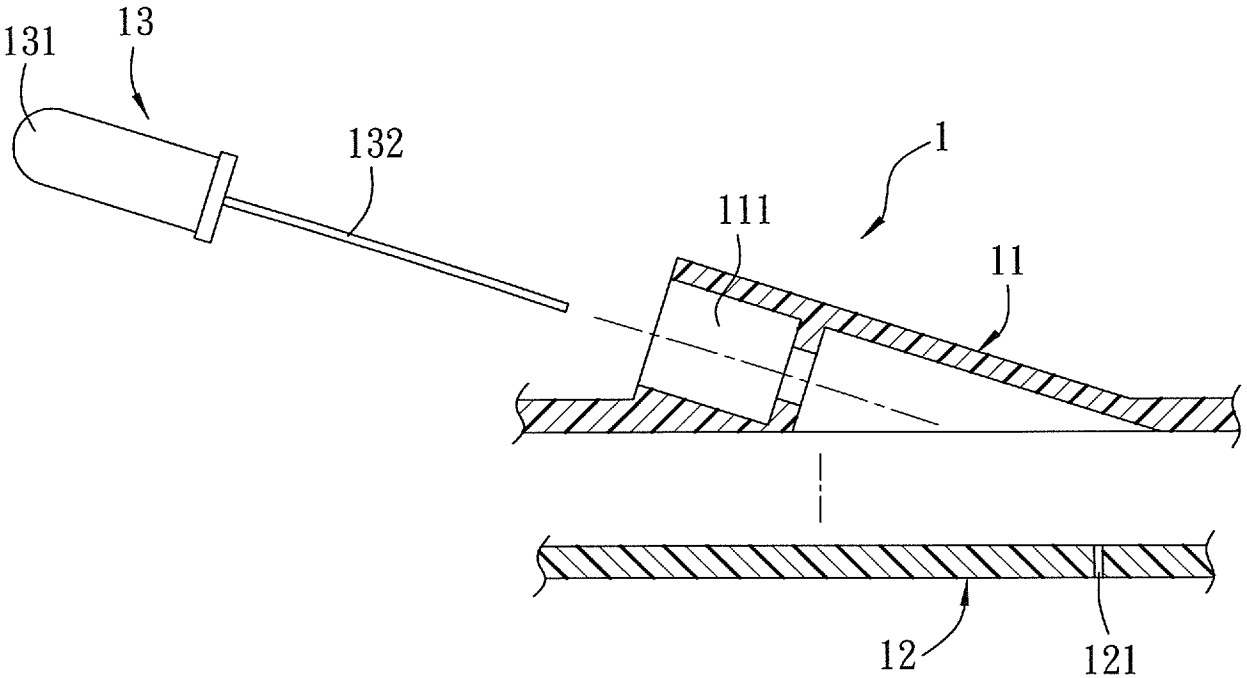
FIG. 1 PRIOR ART
FIG. 1 is an exploded sectional view of a conventional LED mounting seat and an LED.
Figure 2:
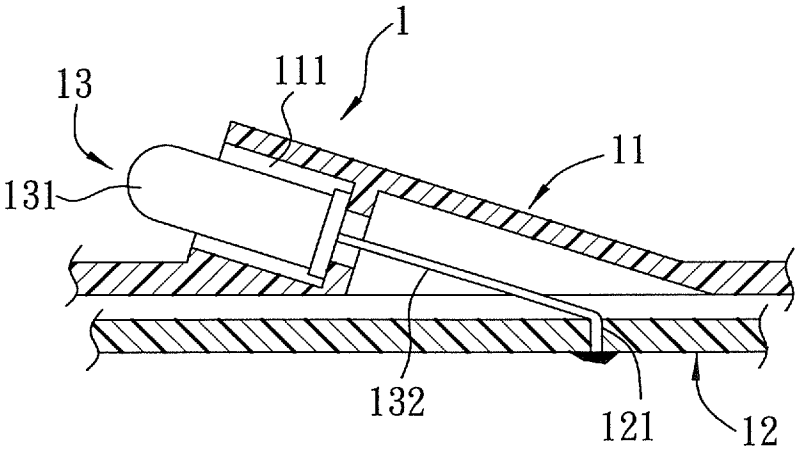
FIG. 2 PRIOR ART
FIG. 2 is an assembled sectional view of the conventional LED mounting seat and the LED.

Before the present invention is described in greater detail, it should be noted that like elements are denoted by the same reference numerals throughout the disclosure.

Figure 3:
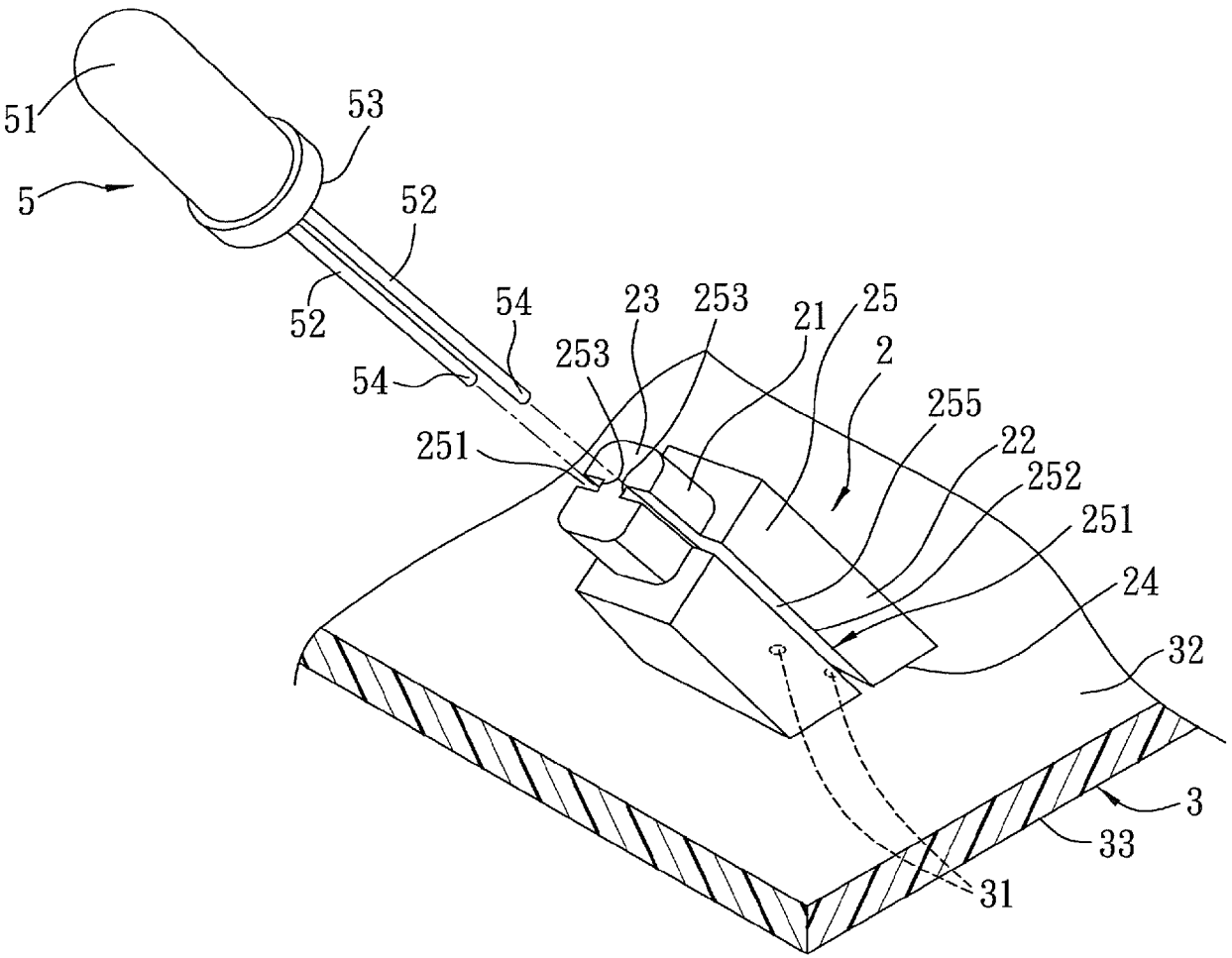
FIG. 3 is an exploded perspective view of an LED and the first preferred embodiment of an LED mounting seat according to this invention.
Figure 4:
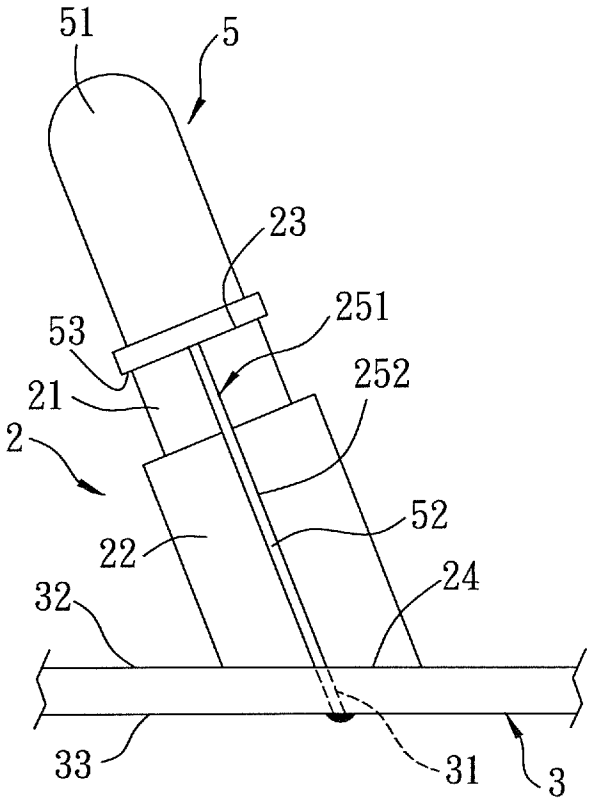
FIG. 4 is an assembled side view of the LED and the first preferred embodiment.
Figure 5:
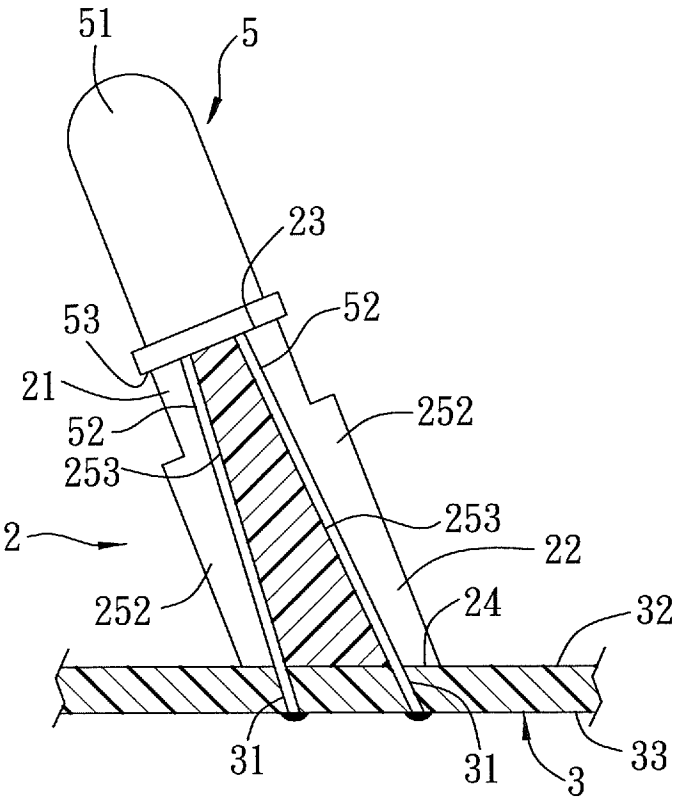
FIG. 5 is a partly assembled sectional view of the LED and the first preferred embodiment.

FIGS. 3 to 5 illustrate a first preferred embodiment of an LED mounting seat 2 adapted to be used in a vehicle lighting system (not shown) for inclinedly mounting a LED 5 to a circuit board 3.

The LED 5 includes a light emitting portion 51 and a pair of leads 52 that are parallel to each other, that are electrically connected to the light emitting portion 51, and that extend from a bottom surface 53 of the light emitting portion 51 of the LED 5.

The LED mounting seat 2 includes a main body having a rectangular prism 22 that has an inclined connecting end 24 connected to a top surface 32 of the circuit board 3, and a four-sided prism 21 that has four rounded longitudinal edges, that is connected to a top surface of the rectangular prism 22 longitudinally opposite to the connecting end 24, and that has a supporting surface 23 longitudinally opposite to the rectangular prism 22. It should be pointed out that the shape of the LED mounting seat 2 should not be limited by the preferred embodiment of this invention.

The supporting surface 23 abuts against the bottom surface 53 of the light emitting portion 51 of the LED 5. The LED mounting seat 2 further has a side surface 25 that is defined cooperatively by side surfaces of the rectangular prism 22 and the four-sided prism 21, and that is formed with a pair of opposite lateral grooves 251 extending from the supporting surface 23 to the connecting end 24. The circuit board 3 is formed with a pair of lead-inserting holes 31 that are respectively in spatial communication with the lateral grooves 251. Each of the lateral grooves 251 has a width equal to the width of each of the leads 52. Each of the lateral grooves 251 is defined by a groove-defining surface 252 and has an opening 255 which is between the supporting surface 23 and the connecting end 24. The groove-defining surface 252 of each of the lateral grooves 251 has an abutting surface portion 253 facing the opening 255 of the corresponding one of the lateral grooves 251. The leads 52 extend respectively through the lateral grooves 251 and abut respectively against the abutting surface portions 253 of the groove-defining surfaces 252. Each of the leads 52 has a distal end 54 that extends through a corresponding one of the lead-inserting holes 31 of the circuit board 3 and is soldered to a bottom surface 33 of the circuit board 3 opposite to the top surface 32. In this embodiment, a distance between the abutting surface portions 253 of the lateral grooves 251 increases from the supporting surface 23 to the connecting end 24. The minimum distance between the abutting surface portions 253 is equal to a distance between the parallel leads 52. When the leads 52 are being inserted into the lateral grooves 251 of the side surface 25 during assembling of the LED 5 to the LED mounting seat 2, the leads 52 will be forced to deform outwardly and resiliently. In the meantime, each of the leads 52 exerts a clamping force against deformation and abuts tightly against the corresponding one of the abutting surface portions 253. Therefore, the LED 5 is able to be rapidly, precisely and stably mounted to the circuit board 3.

Figure 6:
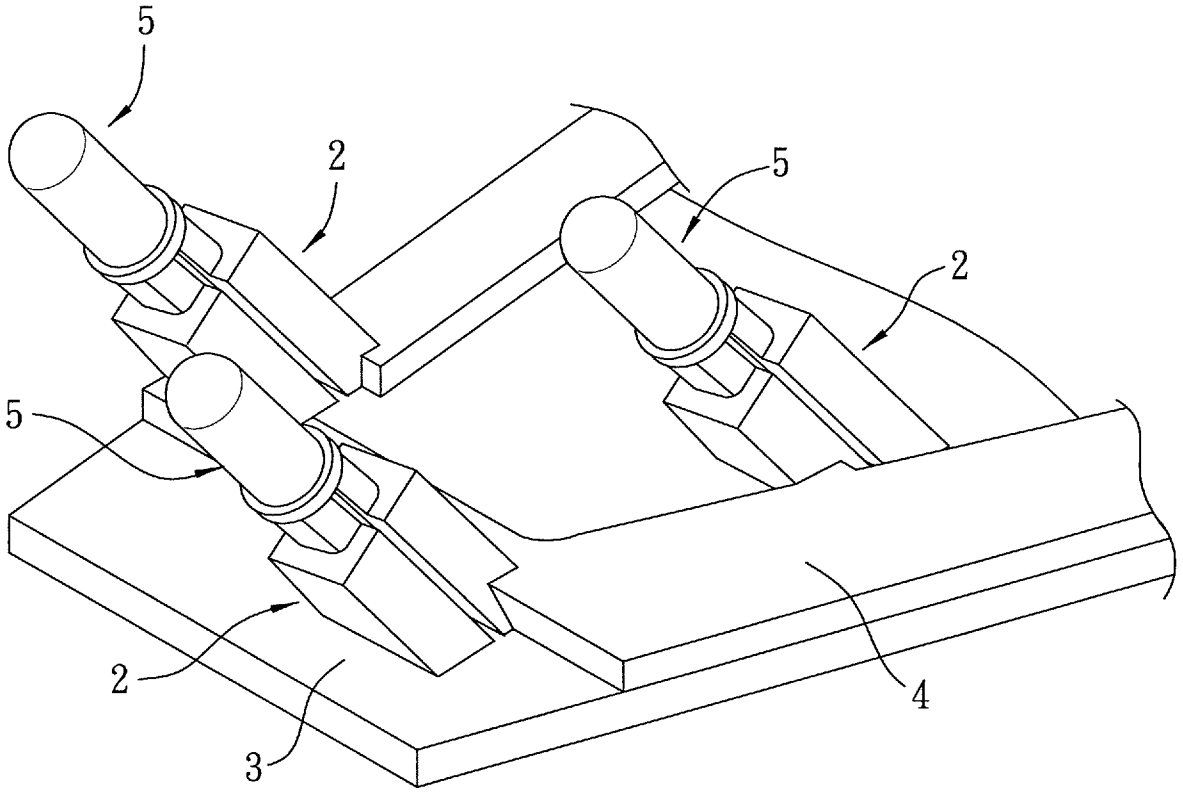
FIG. 6 is a perspective view of a plurality of the LED mounting seats of the first preferred embodiment connected to a rib structure.

As shown in FIG. 6, a plurality of the LED mounting seats 2 of this invention may be connected to a rib structure 4 which is mounted on the circuit board 3 instead of being mounted individually on the circuit board 3. With the use of the rib structure 4, the LED mounting seats 2 may be rapidly mounted to the circuit board 3.

Figure 7:
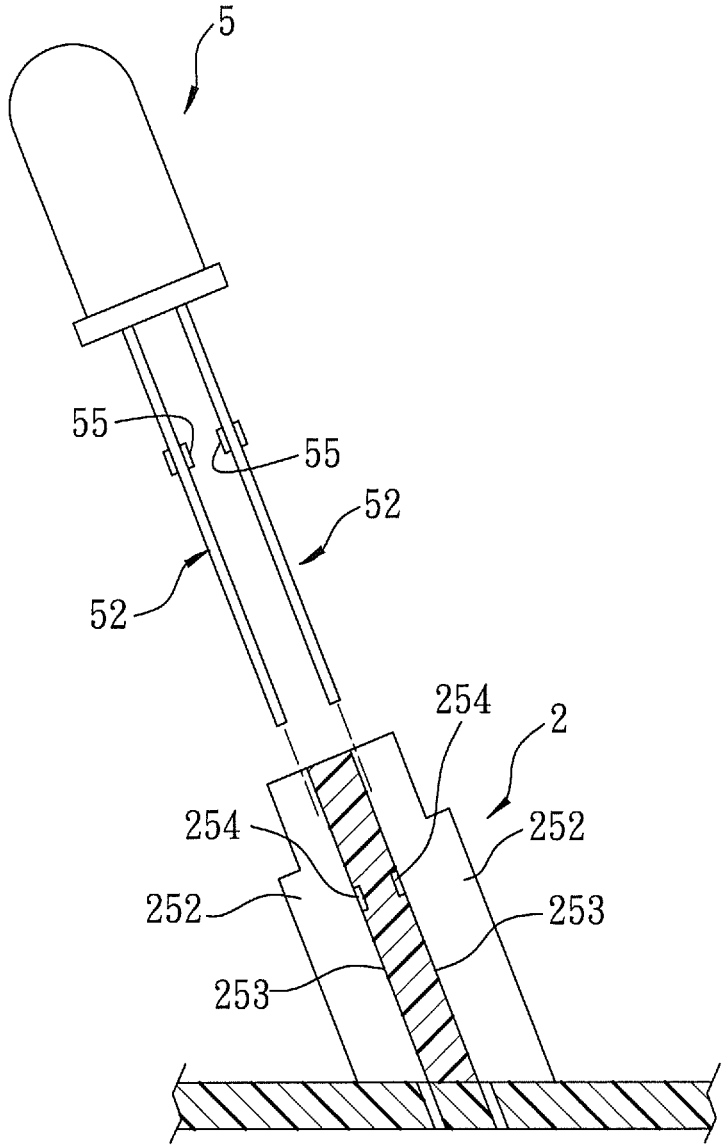
FIG. 7 is a partly exploded sectional view of an LED and a second preferred embodiment of the LED mounting seat according to this invention.
Figure 8:
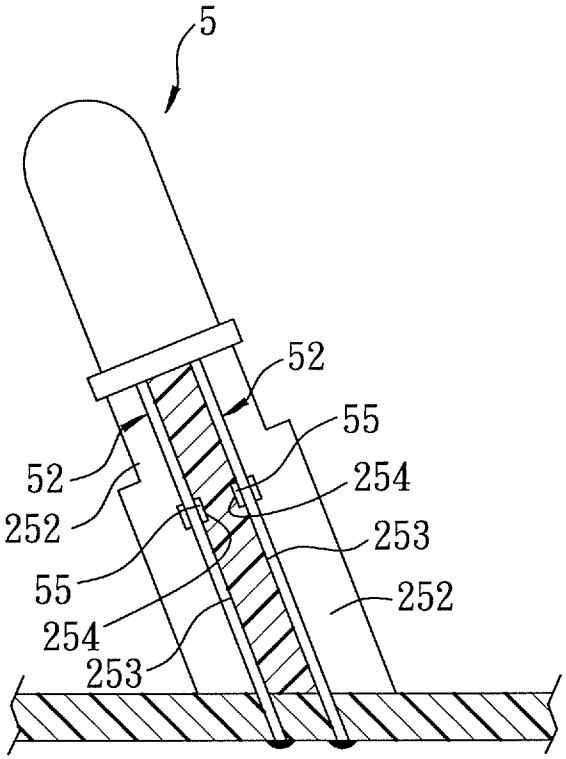
FIG. 8 is a partly assembled sectional view of the LED and the second preferred embodiment.

FIGS. 7 and 8 illustrate a second preferred embodiment of the LED mounting seat 2 according to the present invention. Differences with respect to the first preferred embodiment reside in the following. In this embodiment, the abutting surface portions 253 of the groove-defining surfaces 252 are mutually parallel. Each of the abutting surface portions 253 is formed with a recess 254. Each of the leads 52 of the LED 5 has a protrusion 55 adapted to engage a corresponding one of the recesses 254 for stably positioning the LED 5 relative to the LED mounting seat 2.

It should be pointed out that the LED mounting seat 2 may not be inclinedly mounted to the circuit board 3. For example, the LED mounting seat 2 may be perpendicular to the circuit board 3 while the supporting surface 23 is parallel to the circuit board 3.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An LED mounting seat adapted to mount a light emitting diode (LED) to a circuit board, the LED having a light emitting portion and a pair of leads that extend from a bottom surface of the light emitting portion, each of the leads having a distal end that extends through the circuit board and that is secured to a bottom surface of the circuit board, said LED mounting seat comprising a main body having:

a supporting surface that is adapted to abut against the bottom surface of the light emitting portion of the LED;

a connecting end that is adapted to be connected to a top surface of the circuit board opposite to the bottom surface of the circuit board; and a side surface that interconnects said supporting surface and said connecting end, and that is formed with opposite lateral grooves extending from said supporting surface to said connecting end, each of said lateral grooves having an opening that is between said supporting surface and said connecting end and being defined by a groove-defining surface that has an abutting surface portion facing said opening, the leads of the LED extending respectively through said lateral grooves and abutting respectively against said abutting surface portions of said groove-defining surfaces, wherein a distance between said abutting surface portions of said groove-defining surfaces increases from said supporting surface to said connecting end.

2. An LED mounting seat adapted to mount a light emitting diode (LED) to a circuit board, the LED having a light emitting portion and a pair of leads that extend from a bottom surface of the light emitting portion, each of the leads having a distal end that extends through the circuit board and that is secured to a bottom surface of the circuit board, said LED mounting seat comprising a main body having:

a supporting surface that is adapted to abut against the bottom surface of the light emitting portion of the LED;

a connecting end that is adapted to be connected to a top surface of the circuit board opposite to the bottom surface of the circuit board; and a side surface that interconnects said supporting surface and said connecting end, and that is formed with opposite lateral grooves extending from said supporting surface to said connecting end, each of said lateral grooves having an opening that is between said supporting surface and said connecting end and being defined by a groove-defining surface that has an abutting surface portion facing said opening, the leads of the LED extending respectively through said lateral grooves and abutting respectively against said abutting surface portions of said groove-defining surfaces, wherein one of each of said lateral grooves and each of the leads is formed with a recess, and the other one of each of said lateral grooves and each of the leads has a protrusion engaging said recess of a corresponding one of said one of each of said lateral grooves and each of the leads.

* * * * *